US005353481A

United States Patent [19]

Farris, Jr.

[11] Patent Number: 5,353,481

[45] Date of Patent: Oct. 11, 1994

[54] SCARF HOLDER

[76] Inventor: Claude T. Farris, Jr., 6653 Navigation, Houston, Tex. 77011

[21] Appl. No.: 27,102

[22] Filed: Mar. 5, 1993

[51] Int. Cl.[5] ..... A44B 21/00

[52] U.S. Cl. ..... 24/545; 24/3 H; 24/563

[58] Field of Search ..... 24/545, 543, 562, 563, 24/67.9, 49 R, 3 H, 3 J, 3 L, 707

[56] References Cited

U.S. PATENT DOCUMENTS

| | | | |
|---|---|---|---|
| D. 141,949 | 8/1945 | Pivcevich | D17/3 |
| D. 158,919 | 6/1950 | Wolff | D17/3 |
| D. 237,845 | 12/1975 | Soji | D2/07 |
| 475,220 | 5/1892 | Lucas | 24/6 |
| 3,348,272 | 10/1967 | Germani | 24/563 |
| 3,639,949 | 2/1972 | Beck | 24/49 |
| 3,748,661 | 7/1973 | Smith | 2/207 |
| 4,038,724 | 8/1977 | Parizek . | |
| 4,706,342 | 11/1987 | Yu | 24/545 |
| 4,928,361 | 5/1990 | Brown | 24/67.9 |
| 5,023,978 | 6/1991 | Thompson et al. . | |
| 5,113,554 | 5/1992 | Gallo et al. | 24/545 |

FOREIGN PATENT DOCUMENTS

| | | | |
|---|---|---|---|
| 1448384 | 6/1966 | France | 24/563 |
| 1148883 | 4/1969 | United Kingdom | 24/67.9 |

*Primary Examiner*—Victor N. Sakran
*Attorney, Agent, or Firm*—Michael Roebuck

[57] ABSTRACT

A device for holding and supporting a scarf or handkerchief in a pocket for ornamental display is disclosed. The scarf holder comprises a frame member which has a slot through which a scarf or handkerchief is passed. A flexible clip member is attached to the front of the frame member near the slot to bias the scarf against the frame member and hold the scarf in place. The frame member when inserted into the pocket of a jacket or blazer is completely covered. The scarf or handkerchief is adjusted to extend above the pocket for display.

5 Claims, 2 Drawing Sheets

Fig. 1
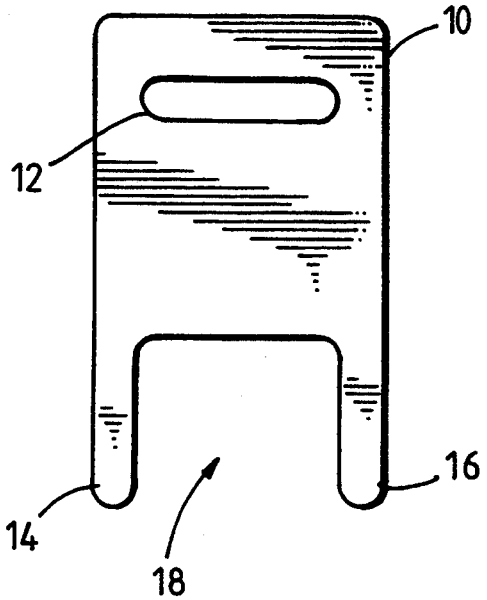
Fig. 2
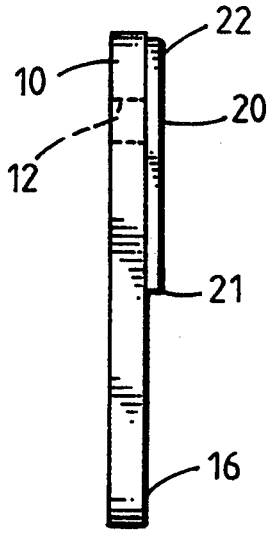
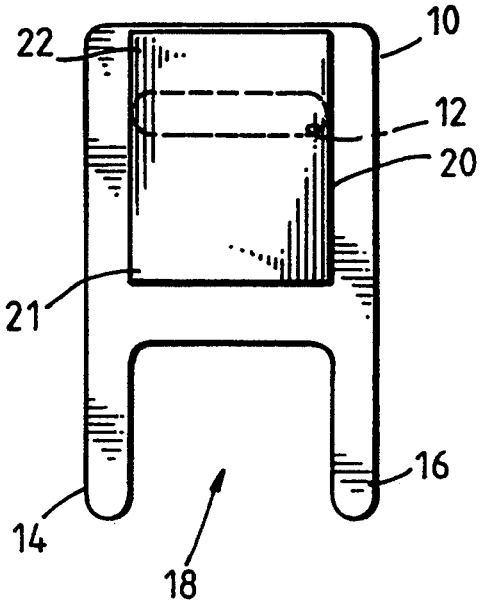
Fig. 3
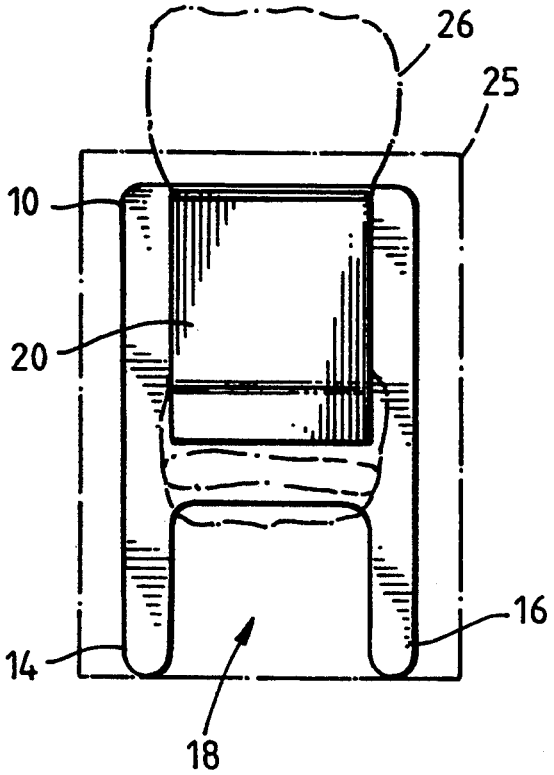
Fig. 4

SCARF HOLDER

BACKGROUND OF THE INVENTION

1. Field the Invention

The present invention relates to a fashion accessory which holds a scarf or handkerchief in the breast pocket of a jacket, blazer or suit coat while allowing a portion of the scarf to be visible. More particularly the invention relates to a device which allows the wearer to adjust the amount of the scarf to be visible and retains that amount until readjusted by the wearer. Most particularly the invention relates to a frame for holding the scarf in the desired position and which fits inside the breast pocket of a jacket or blazer.

2. Related Information

Scarves or handkerchiefs are often placed in a shirt or coat pocket to achieve a desired ornamental effect. Difficulty may be encountered in placing and supporting the scarf or handkerchief in the desired shape and location. Once the desired position and effect have been achieved the scarf or handkerchief is often disturbed by body movement or removal of the shirt of coat. Additionally, once the scarf or handkerchief is removed from the pocket the process of adjustment must be repeated again.

Scarf holders having rings or grommets for holding scarves around the neck or head are well known in the art. See, for example, design patents U.S. Pat. Nos. Des. 158,919 and Des 141,949. Additionally U.S. Pat. No. 3,748,661 discloses an adjustable scarf which is attached to a ring at one end and having the other end free to encircle the neck. U.S. Pat. No. 4,038,724 discloses a pendant for retaining a scarf about the wearer's neck with separate loops for holding the individual ends of the scarf apart. U.S. Pat. No. 3,639,949 discloses a scarf clip as does U.S. Pat. No. 5,023,978.

As may be noted, while there are several devices for retaining the front end of scarves or handkerchiefs together there is no disclosure of a frame for supporting a handkerchief or scarf in a pocket.

It is an object of the present invention to provide a device for supporting a handkerchief or scarf in a pocket.

It is another object of the invention to provide for adjustment and interchangeability of the handkerchief or scarf.

It is another object of the invention to provide a device that may be removed and inserted repeatedly into a pocket with little adjustment of the scarf while allowing for easy removal and adjustment of the scarf when desired.

SUMMARY OF THE INVENTION

The scarf holder of the present invention comprises a frame having legs at one end and a horizontal slot at the opposite end. A clip member is attached to the front which extends over the slot and is biased against the front. A scarf or handkerchief is passed between the leg members and through the slot. The biased clip member holds the scarf in the desired position.

BRIEF DESCRIPTION OF THE DRAWING

FIG. 1 is back plan view of one embodiment of the scarf holder of the present invention.

FIG. 2 is a side plan view of the embodiment of FIG. 1.

FIG. 3 is a front plan view of the embodiment of FIG. 1.

FIG. 4 is a front plant view of the embodiment of FIG. 1 showing use with a scarf.

DESCRIPTION OF THE PREFERRED EMBODIMENTS

Figure 5:
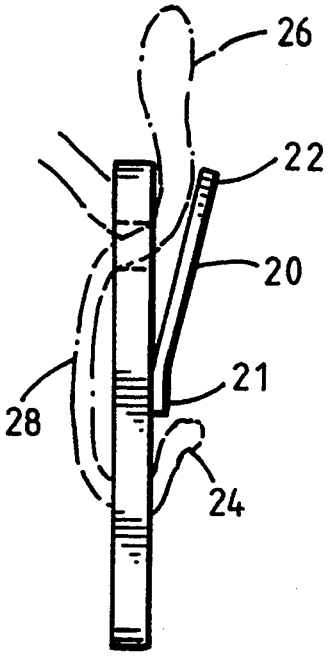
FIG. 5 is a side plan view of the embodiment of FIG. 1 showing use with a scarf.

For a detailed description of the preferred embodiments the reader is referred to the attached figures in which like components have been given like reference numerals for ease of reference.

Referring first to FIGS. 1–3 one embodiment of the scarf holder is shown in plan view. The scarf holder is shown to comprise a frame member 10 of generally rectangular construction. Extending from the lower part of the frame member 10 are two leg members 14 and 16 which define a space 18 between. Near the top of frame member 10 is a slot 12 which extends horizontally across the frame member 10. As seen in FIGS. 2 and 3 there is a flexible clip member 20 secured to the front of the frame member. The clip member 20 is secured to the front of the frame member near the bottom at 21. The top portion 22 of the clip 20 is flexible and extends over the slot 12.

Figure 6:
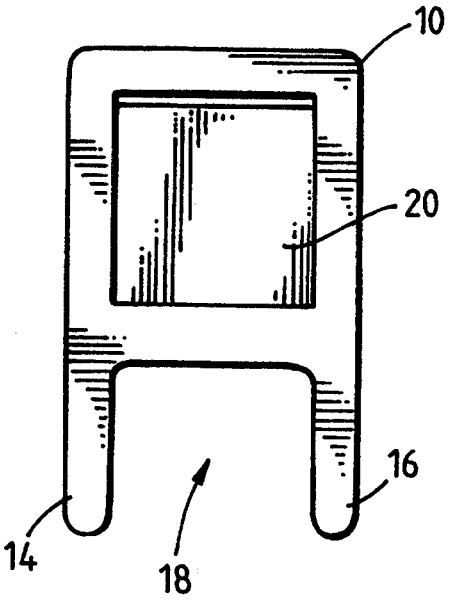
FIG. 6 is a back plan view of a second embodiment of the scarf holder of the present invention.
Figure 7:
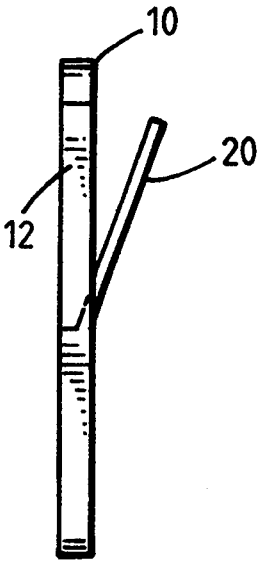
FIG. 7 is a side plan view of the embodiment of FIG. 6.

Referring now to FIGS. 6 and 7 a second embodiment of the invention is shown. In this embodiment the scarf holder is of a single piece construction. The flexible clip 20 is cut out of the frame member 10. When the clip 20 is flexed outward, it leaves an opening 12 which functions as the slot of the first embodiment. Otherwise the operation and functions are identical to the first embodiment shown in FIGS. 1–5.

Referring now to FIGS. 4 and 5 the use of the holder is illustrated. The scarf 26 is positioned such that the lower end 24 is passed through space 18 for concealment in a pocket 25. The scarf is then pulled about the frame member and passed through the slot 12 the desired length for exposure above the pocket 25. The flexible clip member 20, which is biased against the front of the frame member 10, presses against the scarf 25 holding it in place.

The scarf may be made of a variety of materials known in the art. If desired the frame member may include at least mirrored surface.

It will be apparent to those skilled in the art that many modifications and changes in the apparatus may be made without departing from the scope and spirit of the invention. It is the intention, therefore, that the following claims cover all equivalent modifications and variations and fall within the scope of the invention as defined by the claims.

The invention claimed is:

1. A scarf holder for fixably positioning a pocket scarf within a suit jacket pocket comprising:

(a) a generally rectangular frame member shaped to fit flatly and snugly witin suit coat pocket having a horizontal opening near the top and two leg members extending from the bottom; and (b) a flexible clip member secured to said frame member and, said clip member being biased against said frame member.

2. The scarf holder of claim 1 wherein said clip member extends over said opening.

3. The scarf holder of claim 1 wherein said opening is a slot.

4. The scarf holder of claim 1 wherein said clip member and said frame member are of one piece.

5. A scarf holder for fixably positioning a pocket scarf within a suit jacket pocket comprising:

(a) a generally rectangular frame shaped to fit flatly and snugly within suit coat pocket having a slot near its upper end and two legs extending from the lower end; and (b) a flexible clip member secured to the front of said frame member and extending over said slot, said clip member being biased against said frame member.

* * * * *